US007846079B1

(12) United States Patent
Eaglin

(10) Patent No.: US 7,846,079 B1
(45) Date of Patent: Dec. 7, 2010

(54) LIGHTWEIGHT PORTABLE TRAINING DEVICE TO SIMULATE KAYAKING

(75) Inventor: Ronald D. Eaglin, Orlando, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 1781 days.

(21) Appl. No.: 10/982,233

(22) Filed: Nov. 5, 2004

(51) Int. Cl.
*A63B 21/00* (2006.01)

(52) U.S. Cl. ..... 482/126; 482/121; 482/907

(58) Field of Classification Search ..... 482/121, 482/126, 904, 97, 34, 40, 72, 69
See application file for complete search history.

(56) References Cited

U.S. PATENT DOCUMENTS

| | | | | | |
|---|---|---|---|---|---|
| 199,967 | A | * | 2/1878 | elton | 182/196 |
| 4,139,079 | A | * | 2/1979 | Clark | 182/93 |
| 4,645,203 | A | * | 2/1987 | Moss | 482/93 |
| 4,762,318 | A | * | 8/1988 | Phillips et al. | 482/126 |
| 5,314,396 | A | | 5/1994 | Parr | 482/126 |
| 5,354,251 | A | | 10/1994 | Sleamaker | 482/96 |
| 5,571,064 | A | * | 11/1996 | Holm | 482/129 |
| 5,624,357 | A | | 4/1997 | Englehart | 482/72 |
| 5,766,118 | A | | 6/1998 | Conner | 482/129 |
| 5,803,876 | A | | 9/1998 | Hickman | 482/72 |
| 5,910,073 | A | * | 6/1999 | Conner | 482/129 |
| 6,106,436 | A | | 8/2000 | Lundahl | 482/1 |
| 6,106,444 | A | * | 8/2000 | Maingart | 482/95 |
| 6,328,677 | B1 | | 12/2001 | Drapeau | 482/72 |
| 7,455,028 | B2 | * | 11/2008 | Baker | 114/362 |
| 2005/0107226 | A1 | * | 5/2005 | Monda | 482/121 |

FOREIGN PATENT DOCUMENTS

| | | |
|---|---|---|
| WO | WO 91/08025 | * 12/1989 |

* cited by examiner

*Primary Examiner*—Jerome Donnelly
(74) *Attorney, Agent, or Firm*—Brian S. Steinberger; Law Offices of Brian S. Steinberger, P.A.

(57) ABSTRACT

Methods and devices for kayak training and/or exercising. One embodiment can use two PVC type pipes (one shorter than the other) in a parallel configuration. A flexible bungee type stretchable cord can be passed through the small pipe and have ends that are each attached to opposite ends of the larger pipe. Ends of another stretchable cord are each fixable attached to ends of the small pipe with a mid portion of the second bungee cord attached to a fixably nonmoveable member such as a door knob and the like. A user sitting down can grip the larger pipe with both hands spread apart and create a rowing action with the device so that the stretched cords simulate rowing actions such as those used with a kayak. The device can also be used as an exercise device and method to tone muscles such as arm and stomach and side muscles of the user. Another embodiment slidably passes the cord through dual through-holes in the ends of the smaller pipe member, and another embodiment substitutes a stretchable cord that has one end attached to a midportion of the smaller pipe and an outer end attached to the fixable nonmoveable object such as the door knob.

5 Claims, 4 Drawing Sheets

100
112
118
110
131
139
130
130
120
130
135
149
141
128
122
140
140
145
2

LIGHTWEIGHT PORTABLE TRAINING DEVICE TO SIMULATE KAYAKING

FIELD OF INVENTION

This invention relates to exercising and training, in particular to an apparatus, devices, systems and methods that simulate effects of rowing in kayaks for use in kayak training and exercise.

BACKGROUND AND PRIOR ART

The act of rowing can be useful as a training tool for learning various skills such as how to operate a kayak, and for exercise purposes. Different types of devices have been proposed in the past that can simulate rowing machines, row boats, and the paddling motion associated with kayaking. However, these devices have inherent problems. For example, these devices are generally complex type machines, heavy to move, difficult to assemble, and expensive to the average consumer. Additionally, these devices are generally not suitable for rowing exercises that are needed for kayak type training. Also, these devices are not easy to use as simple exercise devices.

Various United States Patents have been proposed over the years for exercise training. See for example, U.S. Pat. Nos. 4,762,318 to Phillips et al.; 5,314,396 to Parr; 5,354,251 to Sleamaker; 5,624,357 to Englehart et al.; 5,766,118 to Conner; 5,803,876 to Hickman; 5,910,073 to Conner; and 6,106,436 to Lundahl; and 6,328,677. However, for similar reasons presented above, none of these devices overcomes all of the problems with the prior art devices listed above.

Thus, the need exists for solutions to these problems.

SUMMARY OF THE INVENTION

A first objective of the present invention is to provide methods, apparatus, devices and systems for easily simulating, in an inexpensive technique, the rowing maneuvers used for training skills for kayaking.

A second objective of the present invention is to provide methods, apparatus, devices and systems for easily simulating, in an inexpensive technique, and rowing maneuvers that can be used as for general exercise.

Methods, devices, apparatus, and systems simulating rowing actions for purposes such as kayak training, rowing, exercising and the like. Embodiments can include attaching a first longitudinal member by a stretchable first cord to a fixed point, gripping the longitudinal member by two hands spread apart from one another, and alternatingly pulling and pushing ends of the longitudinal member away from the fixed point to stretch and contract the cord to simulate a rowing action.

The invention can also include attaching a second longitudinal member between the first longitudinal member and the fixed point by a stretchable second cord, the second longitudinal member being shorter than the first longitudinal member, and include passing the first longitudinal cord through hollow ends of the second longitudinal member so that the second longitudinal member slides along the first longitudinal cord. The attaching of the second longitudinal member by the stretchable second cord can also include fixably attaching ends of the stretchable second cord to ends of the second longitudinal member, and attaching a mid portion of the stretchable second cord to the fixed point.

The invention can use stretchable cords and cables, and the like, with the longitudinal members.

In a preferred embodiment, the first longitudinal member can provides a stable tension on the cables/cords running between the first and second longitudinal member to simulate the resistance of water against a kayak paddle. This resistance is the primary resistance that is overcome by the tension of the muscular action of the exerciser.

Further objects and advantages of this invention will be apparent from the following detailed descriptions of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

First Embodiment

Figure 1:
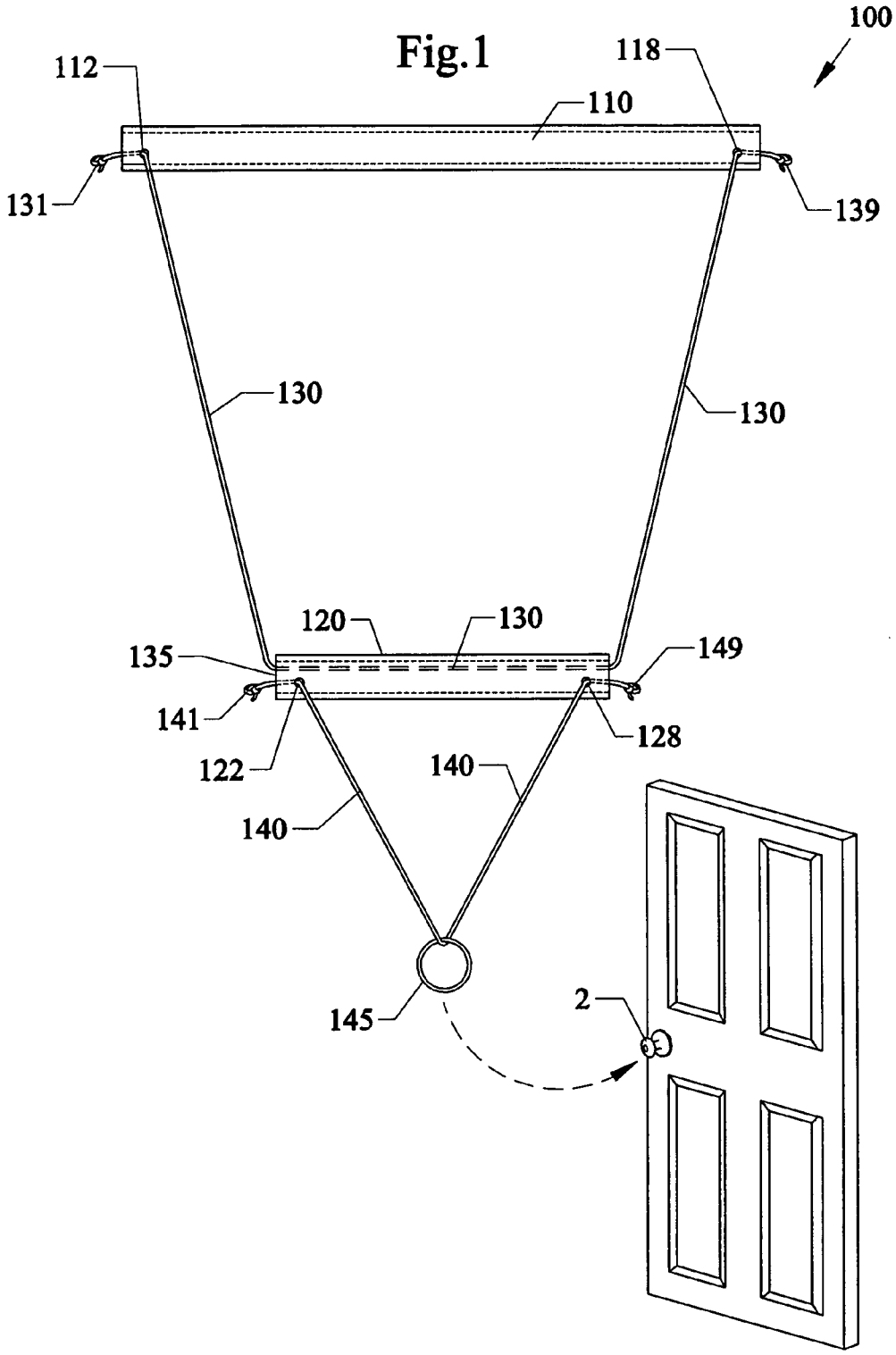
FIG. 1 shows a top view of a first preferred embodiment of a novel kayak/exercise device.

FIG. 1 shows a top view of a first preferred embodiment of a novel kayak/exercise device. A first rigid longitudinal member 110 such as a PVC pipe that can be approximately 40 to approximately 44 inches long can include small openings 112, 118 adjacent to its ends (for example within approximately ½ inch of the pipe ends) for allowing ends 131, 139 of a first stretchable cord 130, such as but limited to a bungee cord, and the like, to be tied into each of the openings 112, 118.

A second rigid longitudinal member 120 such as a shorter PVC pipe having a length of approximately 12 inches can have a mid portion of the first stretchable cord loosely passing through a hollow longitudinal center portion 135 of the second pipe. Both PVC type pipes 110, 120 can have outer diameters of approximately 2 inches, wherein the longer PVC pipe 110 can be used to simulate the long handle on an oar that is used for rowing. Ends 141, 149 of a second stretchable cord 140, such as but not limited to a bungee cord, and the like, can be tied off through openings 122, 128 adjacent to the ends of the second pipe 120, and a mid portion of the second cord can be attached by a loop 145, and the like, to a fixed point such as a door knob 2, and the like.

The distance between the fixed point 2 and the short pipe member 120 using the stretchable cord 140 in a non-stretched position can range from approximately 2 to approximately 4 feet. The distance between the parallel pipe members 110, 120 can be approximately 2 feet. The stretchable cords 130, 140 can have variable tensions such as being stretchable at different tensile strengths. Thus, the user can for example add or take away or use different combinations of extra cords to increase, decrease, and adjust, their exercises, strength training, and the like, as desired.

Figure 2:
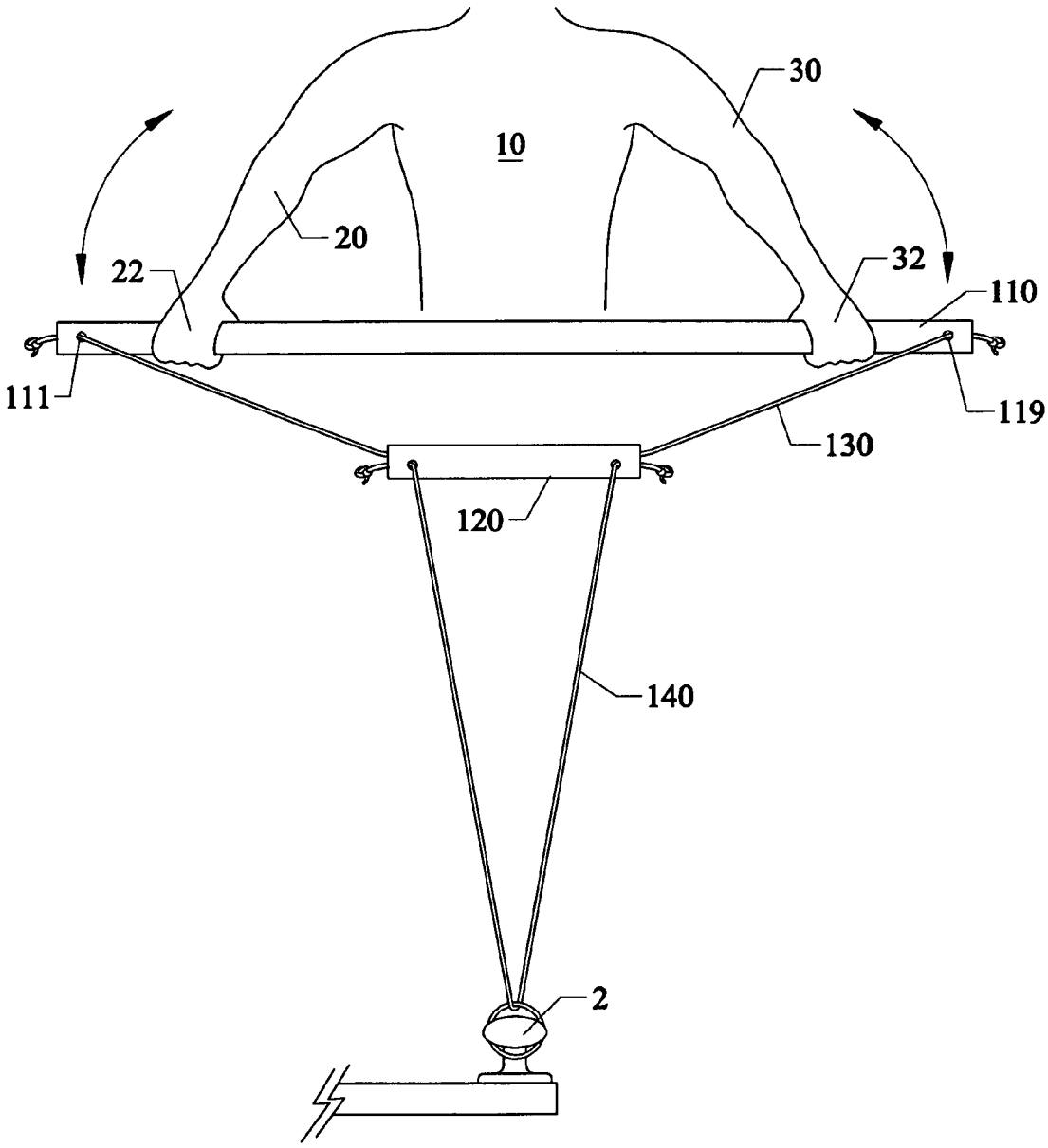
FIG. 2 shows the first embodiment kayak/exercise device of FIG. 1 being used.

FIG. 2 shows a top view of the first embodiment kayak/exercise device 100 of FIG. 1 being used. A user 10 in a sitting position in front of the fixed point 2, such as a doorknob on a closed door, can grip their hands 22, 32 in a spaced apart orientation about left and right portions of the longer pipe member 110 so that the user grips longitudinal sides of the long pipe member adjacent to the pipe ends 111, 119. The user 10 can alternate pulling and pushing their left hand 32 and left arm 30 and their right hand 22 and right arm 20 from their body 10 to simulate a rowing action.

The various stretching and compressing of the first cord 130, and second cord 140 can be used as training for kayaking and/or exercising arms, chest, stomach, side muscles and the like, of the user 10. During the pushing and pulling actions, the cord 130 passing through the second pipe member 120 allows for the cord 130 and the second pipe member 120 to be able to slide and move relative to one another.

The first longitudinal member provides a stable tension on the stretchable cables/cords running between the first and second longitudinal member to simulate the resistance of water against a kayak paddle. This resistance is the primary resistance that is overcome by the tension of the muscular action of the exerciser.

Additionally, the user 10 can pull and push their respective hands 22, 32 that are gripped about the first member 110 in rolling actions, circular actions, and the like, and other manipulations as desired for further training and exercising benefits.

Second Embodiment

Figure 3:
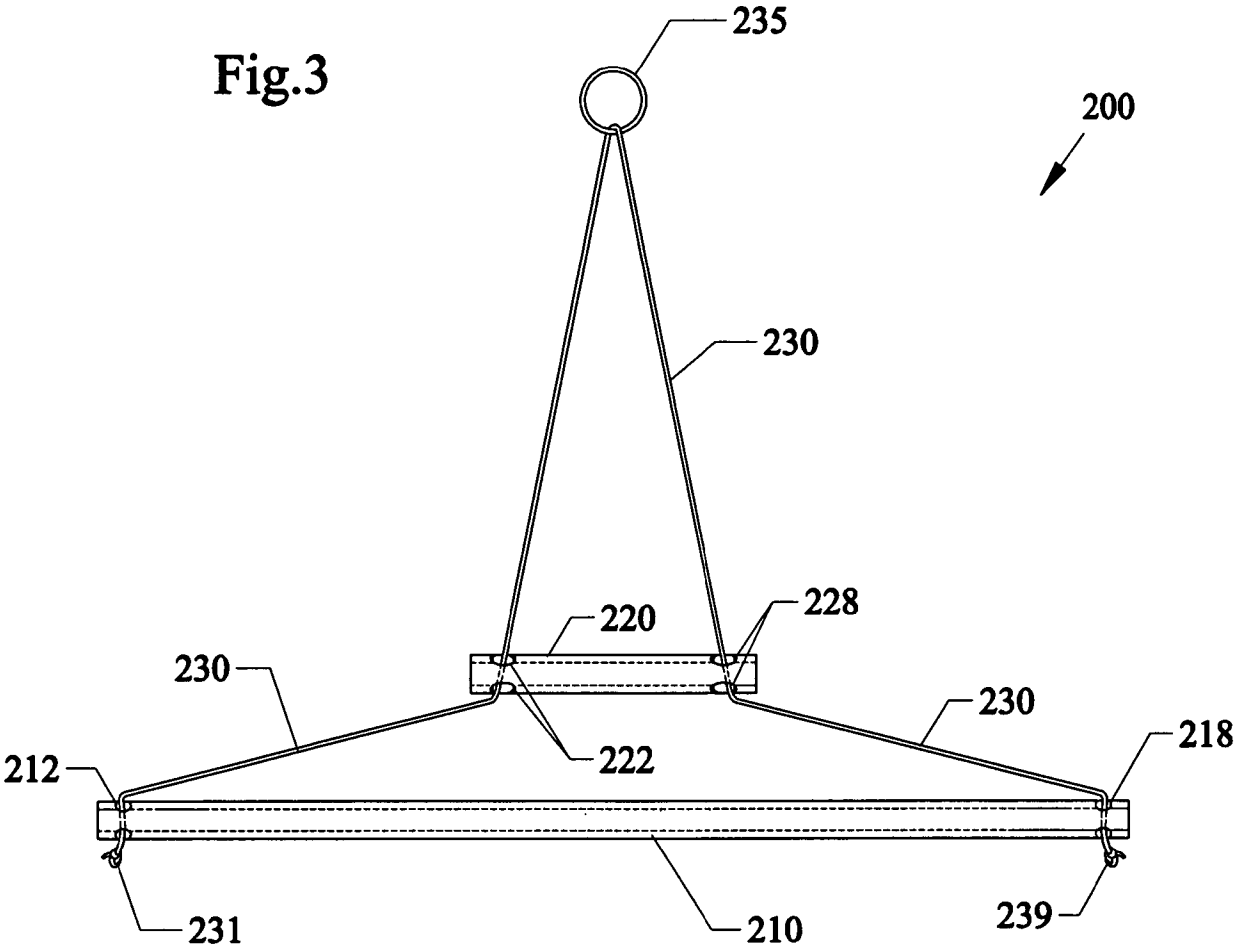
FIG. 3 shows a top view of a second preferred embodiment of the kayak/exercise device.

FIG. 3 shows another embodiment 200 wherein one stretchable cord 230 passes through dual end through-holes 122, 128 of the shorter pipe member 220, and is tied off 231, 239 through end holes 212, 218 of the longer pipe member 210. The FIG. 3 embodiment 200 can be similarly used to the first embodiment for simulating rowing action to enhance kayaking skills and/or for exercising arms, chest, stomach, side muscles, and the like, of the user. Cord 230 can slide and move relative to small pipe member 220. Also, the pipe member 220 can be moved to be closer to the mid-loop portion 235 of the cord 230 or closer to the long pipe member 210 to adjust tension and the like, as desired.

Third Embodiment

Figure 4:
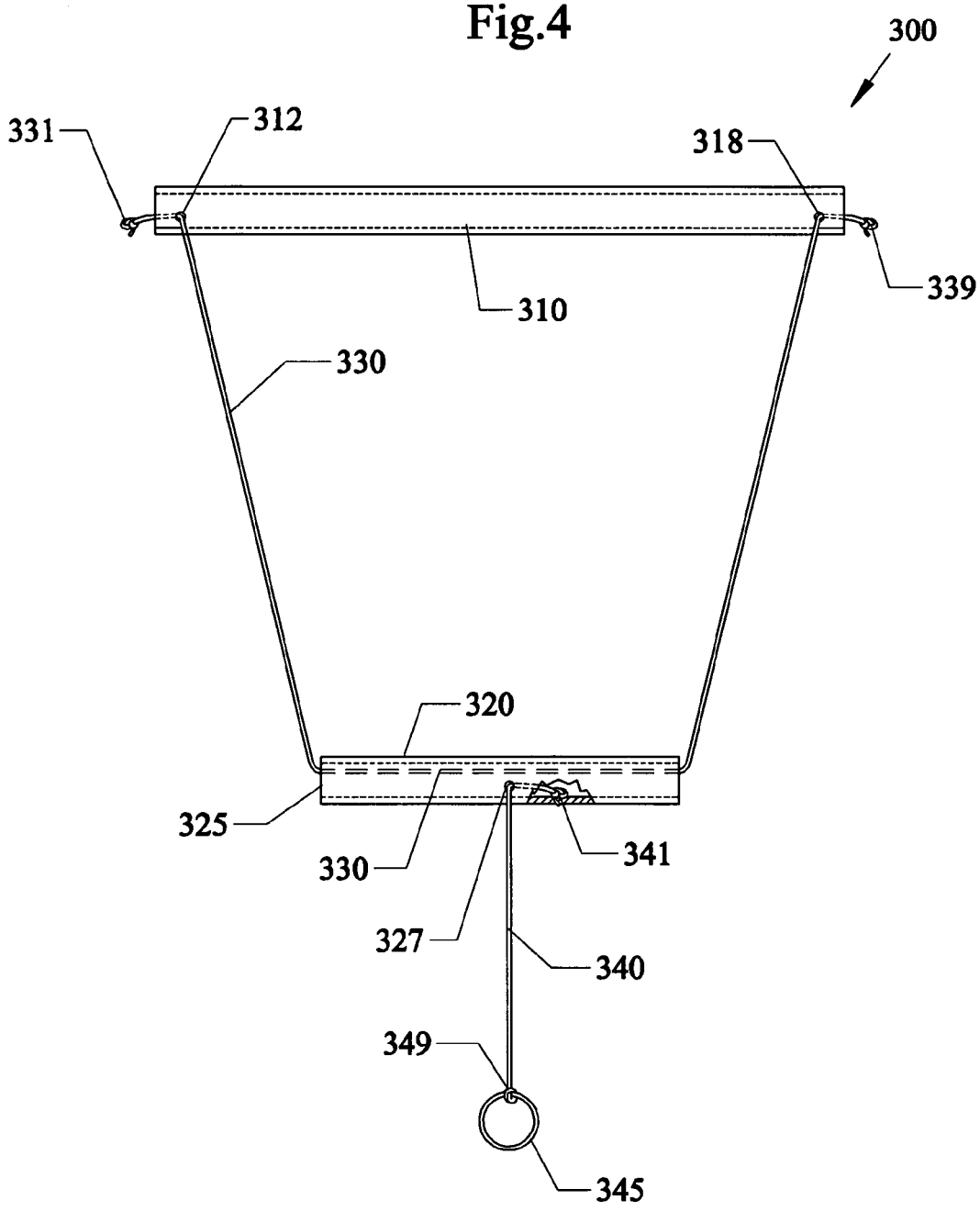
FIG. 4 shows a top view of a third preferred embodiment of the kayak/exercise device.

FIG. 4 shows a top view of a third preferred embodiment 300 of the kayak/exercise device. Here, the second stretchable cord 340 can be attached to and tied 341 to a mid portion 327 of the second shorter pipe member 320, and have an opposite end 349 attached to the fixed point 345, such a door knob, and the like. Similar to the first embodiment, the first cord 330 can have tied or knotted ends 331, 339 that can attach to the long pipe member 310 through end holes 312, 318, and a midportion of the cord 330 can pass through the hollow interior 325 of the short pipe member 320. This embodiment can also be used in a similar manner to the previous embodiments.

Although the embodiments refer to using stretchable cord (s), the invention can use other stretchable members such as cables, straps, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A training device for a user in a sitting position comprising:

a first stretchable cord attached to a fixed point;

a first longitudinal rigid member having ends attached to the stretchable cord, wherein the first rigid member includes a PVC pipe;

a second stretchable cord attached to the first longitudinal member; and a second longitudinal rigid member having ends attached to the second stretchable member, wherein the user grabs ends of the second longitudinal member so that alternatingly pulling end portions of the second longitudinal member stretches and compresses the first and second cords to simulate a rowing action, wherein the first longitudinal member provides a stable tension on the cord running between the first and second longitudinal member to simulate the resistance of water against a paddle, the resistance being overcome by the tension of the muscular action of the exerciser.

2. The device of claim 1, wherein the fixed point includes: a door knob.

3. An exercise device comprising:

a first stretchable cord attached to a fixed point;

a first longitudinal rigid member having opposite end portions attached to the first stretchable cord, wherein the first longitudinal member is a hollow tubular member;

a second stretchable cord attached to the first longitudinal rigid member; and a second longitudinal rigid member having end portions attached to the second stretchable member, wherein the user alternatingly pulling end portions of the second longitudinal member stretches and compresses the first and second cords.

4. The exercise device of claim 3, wherein the end portions of the first longitudinal member are each fixably attached to ends of the first stretchable cord.

5. The exercise device of claim 3, wherein the first stretchable cord slides through the hollow tubular member.

* * * * *